United States Patent [19]

Horn et al.

[11] Patent Number: 4,838,532

[45] Date of Patent: Jun. 13, 1989

[54] FLUID OPERATED CLAMPING DEVICE INCLUDING FLUID PRESSURE LOCKING MEANS

[75] Inventors: Edward R. Horn, Nashotah; Derek Hopkinson, Menomonee Falls, both of Wis.

[73] Assignee: Aladdin Engineering & Mfg., Inc., Brookfield, Wis.

[21] Appl. No.: 256,129

[22] Filed: Oct. 6, 1988

Related U.S. Application Data

[63] Continuation of Ser. No. 83,772, Aug. 10, 1987, abandoned.

[51] Int. Cl.[4] ..... B25B 5/06

[52] U.S. Cl. ..... 269/23; 269/32; 269/94

[58] Field of Search ..... 269/25, 27, 32, 91, 269/92, 93, 94, 20, 24, 23; 91/410; 254/2 B, 8 B, 93 H

[56] References Cited

U.S. PATENT DOCUMENTS

| | | | |
|---|---|---|---|
| 2,585,045 | 2/1952 | Schmidlin . | |
| 2,959,188 | 11/1960 | Kepner . | |
| 3,229,721 | 1/1966 | Bingel . | |
| 3,335,750 | 8/1967 | Kepner . | |
| 3,792,715 | 2/1974 | Parrett et al. . | |
| 3,817,154 | 6/1974 | Martin . | |
| 3,967,817 | 7/1976 | McClocklin | 269/32 |
| 3,975,987 | 8/1976 | Panis . | |
| 3,980,336 | 9/1976 | Bitonti . | |
| 4,018,136 | 4/1977 | Kaetterhenry . | |
| 4,172,582 | 10/1979 | Bobnar . | |
| 4,192,338 | 3/1988 | Gerulis . | |
| 4,445,666 | 5/1984 | McDermott | 254/93 H |
| 4,531,449 | 7/1985 | Reith . | |
| 4,576,367 | 3/1986 | Horn et al. . | |
| 4,667,570 | 5/1987 | Jensen, Jr. et al. . | |

FOREIGN PATENT DOCUMENTS 57-65403 4/1982 Japan .

OTHER PUBLICATIONS

Legris Inc., Blocking Fitting, catalogue.

*Primary Examiner*—Robert C. Watson
*Attorney, Agent, or Firm*—Michael, Best & Friedrich

[57] ABSTRACT

Apparatus for gripping a workpiece including a pneumatic cylinder assembly having a locking valve for selectively locking air in the pneumatic cylinder to thereby maintain the gripping apparatus in clamped engagement with a workpiece.

14 Claims, 2 Drawing Sheets

FLUID OPERATED CLAMPING DEVICE INCLUDING FLUID PRESSURE LOCKING MEANS

This application is a continuation of application Ser. No. 083,772, filed Aug. 10, 1987 now abandoned.

FIELD OF THE INVENTION

The invention relates to pneumatically operated clamping and gripping devices for engaging a workpiece and more particularly to such apparatus including means for selectively locking the air in a pneumatic cylinder for a clamping or gripping device.

BACKGROUND PRIOR ART

U.S. Pat. No. 4,576,367, issued Mar. 18, 1986, to Horn et al. and assigned to the assignee of the present invention illustrates a pneumatically operated clamp of the type for use in industrial applications and for use, for example, in securing a workpiece in place during a machining, grinding, fabrication, assembly or welding operation. Such clamps generally include a clamp member automatically moveable between a workpiece clamping position and a release position. They also include a pneumatic cylinder for causing such movement of the clamp member and for maintaining a clamping force on the clamp member when the clamp member is in a clamping position. Similar apparatus are used in conveying assemblies as gates for selectively stopping movement of conveyed articles. Attention is also directed to prior art apparatus for selectively locking or controlling fluid flow in a hydraulic or pneumatic circuit. Such apparatus is illustrated in the Kepner U.S. Pat. No. 2,959,188, issued Nov. 8, 1960; the Kepner U.S. Pat. No. 3,335,750, issued Aug. 15, 1967; Kaetterhenry U.S. Pat. No. 4,018,136, issued Apr. 19, 1977; and the Panis U.S. Pat. No. 3,975,987, issued Aug. 24, 1976. Attention is also directed to the Gerulis U.S. Pat. No. 4,192,338, issued Mar. 11, 1980; the Bobnar U.S. Pat. No. 4,172,582, issued Oct. 30, 1979; the Bitonti U.S. Pat. No. 3,980,336, issued Sept. 14, 1976; the Martin U.S. Pat. No. 3,817,154, issued June 18, 1974; the Parrett et al U.S. Pat. No. 3,792,715, issued Feb. 19, 1974; the Reith U.S. Pat. No. 4,531,449, issued July 30, 1985; and the Bingel U.S. Pat. No. 3,229,721, issued Jan. 18, 1966.

Prior art locking valve cartridges for use in connection with a fluid cylinder and for preventing discharge of fluid pressure from the cylinder are illustrated in a catalog titled Hydraulic and Pneumatic Check and Relief Check Valves, issued by Kepner Products Company, Villa Park, Ill.

SUMMARY OF THE INVENTION

The present invention relates to an improved apparatus for engaging a workpiece or article, the apparatus having a pneumatic cylinder assembly with an improved means for selectively locking air in the pneumatic cylinder to thereby maintain the apparatus in engagement with the workpiece. More particularly, the invention includes an improved apparatus for engaging a workpiece or article and including a pneumatic cylinder assembly having a valve assembly for selectively permitting exhaust of air from the pneumatic cylinder and for locking the air in the pneumatic cylinder in the event of loss of air pressure in the supply conduit supplying air pressure to the cylinder.

The apparatus embodying the invention includes a base, a workpiece or article engaging member supported by the base for shiftable movement between a workpiece engaging position and a workpiece release position, and means for causing selective movement of the workpiece engaging member between the workpiece engaging position and the workpiece release position, the means for causing selective movement including a pneumatic cylinder and a piston housed in the cylinder, the piston being connected to the workpiece engaging member such that movement of the piston in a first direction causes movement of the workpiece engaging member to the workpiece engaging position and movement of the piston in an opposite direction causes movement of the workpiece engaging member to a release position. The apparatus also includes means for supplying air pressure to the cylinder including means for selectively locking air in the cylinder in the event the supply of air pressure to the cylinder is interrupted.

In one embodiment of the invention the means for selectively locking air in the cylinder includes a valve bore, the first portion of the valve bore being in communication with the source of air pressure, and a second portion of the valve bore being in communication with end valve bore communicating with one end of the cylinder whereby air can be supplied to the cylinder to cause movement of the piston in the first direction, a valve seat between the first portion of the valve bore and the second portion of the valve bore, a valve member selectively engageable with the valve seat, and means for resiliently biasing the valve member against the valve seat to releasably prevent air flow from the air pressure source to the first end of the cylinder.

In one embodiment of the invention the valve bore is formed in the cylinder base.

In one embodiment of the invention means are provided for forcing the valve member away from the valve seat and including a valve cylinder and a plunger housed in the cylinder, one end of the plunger being adapted to selectively engage the valve member to force the valve member away from the valve seat and an opposite end of the plunger piston, and means for providing fluid communication between the opposite end of the clamp cylinder and the valve cylinder to provide for air pressure on the plunger to force the plunger into engagement with the valve member.

In one embodiment of the invention the valve bore is a longitudinal axis colinear with the valve cylinder longitudinal axis.

In one embodiment of the invention means are also provided for manually forcing the valve member away from the valve seat and including a pin having opposite ends, one end of the pin being adapted to engage the plunger to force the plunger against the valve member to move the valve member away from the valve seat, the pin including an opposite end positioned so as to be adapted to be manually engaged whereby the pin can be forced against the plunger to cause the plunger to move the valve member away from the valve seat.

Various features and advantages of the invention will be apparent by reference to the following description of a preferred embodiment, from the drawings and from the claims.

Figure 1:
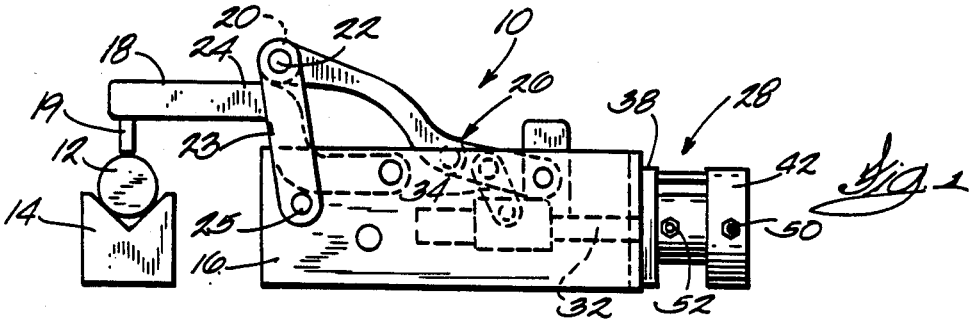
FIG. 1 is an elevation view of a fluid pressure operated clamp apparatus embodying the invention.

Before describing a preferred embodiment of the invention in detail, it is to be understood that the invention is not limited to the details of construction and to the arrangement of the components set forth in the following description or illustrated in the drawings. The invention is capable of other embodiments and of being practiced and carried out in various ways. Also, it is to be understood that the phraseology and terminology employed herein is for the purpose of description and should not be regarded as limiting.

DESCRIPTION OF A PREFERRED EMBODIMENT

Illustrated in FIG. 1 is a clamp assembly 10 for use in selectively securing a workpiece 12 in place in a fixture 14. The clamp assembly includes a frame 16 and a pivotably movable clamp member 18 supported for pivotal movement between a clamping position, shown in FIG. 1, wherein an end 19 of the clamp member 18 clampingly engages the workpiece 12, and a second position (not shown) wherein the workpiece 12 is released. While in the illustrated arrangement, the apparatus embodying the invention includes a single moveable clamp member 18 for securing a workpiece to the fixture 14, in other arrangements, the apparatus could have one or more moveable workpiece engaging members and could comprise an apparatus for clamping a workpiece against a fixed workpiece support or an apparatus for gripping and moving a workpiece from one work station to another.

In the construction shown in FIG. 1, means are also provided for causing movement of the clamp member 18 between the clamping position and the release or retracted position. This means includes a roller 20 supported on a shaft 22 and adapted to engage in upper surface 24 of the clamp member 18. The shaft 22 is supported by the upper ends of a pair of pivotable links 23, the lower ends of the links 23 being pivotally joined to the frame 16 by pins 25. A toggle linkage 26 having an end connected to the roller 20 is provided for causing movement of the roller 20 into engagement with the upper surface 24 of the clamp member. The construction and operation of the toggle assembly 26 and the clamp member 18 are illustrated and described in greater detail in applicant's U.S. Pat. No. 4,576,367, and the description of that patent is incorporated herein by reference.

Figure 2:
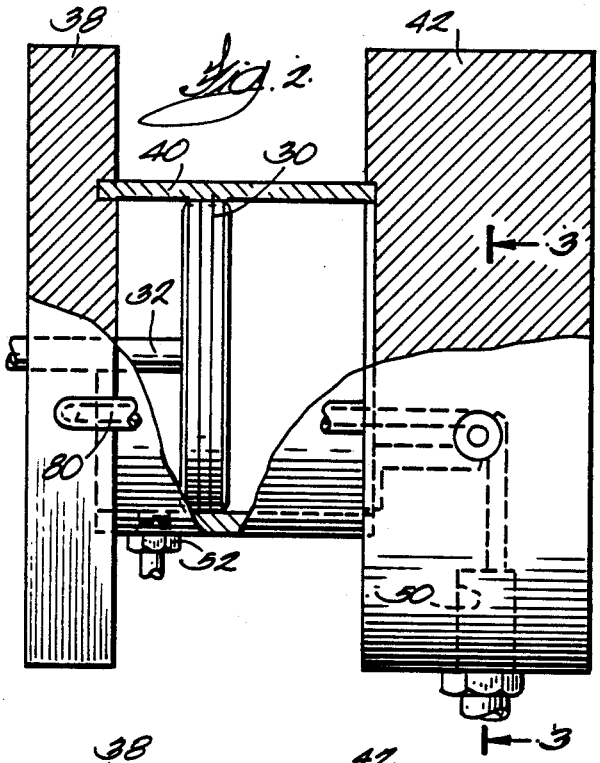
FIG. 2 is an enlarged partial view of apparatus shown in FIG. 1 and with portions broken away.

The means for causing clamping movement of the clamp member 18 also includes a pneumatic cylinder assembly 28 fixed to the frame 16 and including a reciprocating piston 30 (FIG. 2) having an end 32 connected by means of a link 34 to the toggle assembly 26. In operation of the pneumatic cylinder assembly, when the piston 30 is extended, the toggle mechanism 26 will force the clamp member 18 into a clamping position. When the piston 30 is retracted, the toggle mechanism 26 will move the clamp member 18 to the retracted or workpiece release position.

In the specific construction shown in the drawings, the pneumatic cylinder assembly 28 includes a cylinder head adapted to be secured to the frame 16 of the clamp device, a cylinder 40 and a cylinder base 42. The piston 30 is housed in the cylinder 40, and the piston rod 32 projects through the cylinder head 38 and includes an end connected to the link 34 of the toggle mechanism 26 in such a manner that extension of the piston 30 in the cylinder 40 to the position shown in FIG. 2 will cause clamping movement of the clamp member 18, and retraction of the piston 30 will cause movement of the clamp member 18 to a release position.

Means are also provided for selectively supplying fluid pressure to the opposite ends of the fluid cylinder 28 to selectively cause extension and retraction of the piston 30. This means for supplying fluid pressure is best illustrated in FIGS. 2-5 and includes a fluid supply line 46 operably connected through a 4-way valve 48 to an advance port 50 and to a return port 52. As will be described in greater detail hereinafter, the advance port 50 supplies fluid to the cylinder 40 to cause advance of the piston 30, and the return port 52 will alternatively provide fluid under pressure to the opposite end of the cylinder 40 to effect return of the piston.

Figure 3:
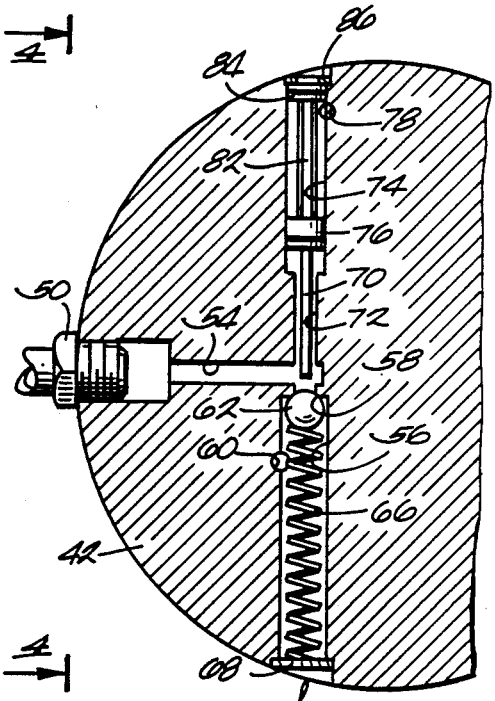
FIG. 3 is a cross section view taken along line 3—3 in FIG. 2.
Figure 4:
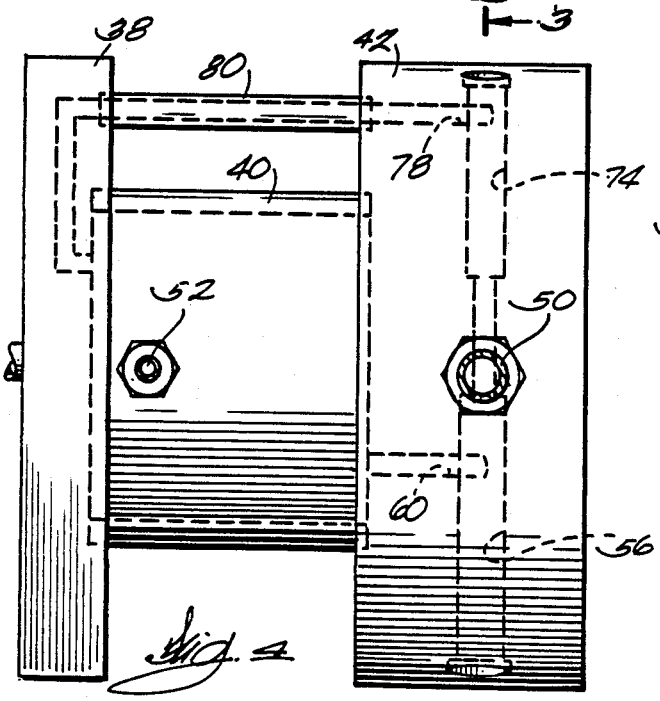
FIG. 4 is a view taken along line 4—4 in FIG. 2.
Figure 5:
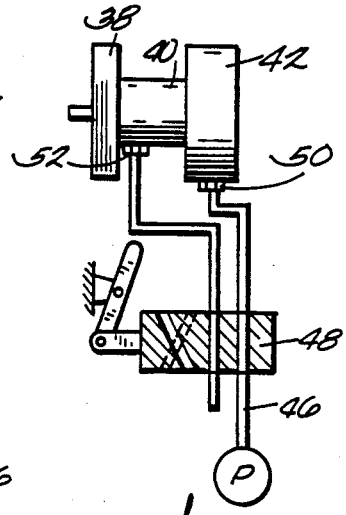
FIG. 5 is a reduced schematic view illustrating fluid pressure control apparatus for controlling operation of the fluid cylinder shown in FIG. 1-4.

As illustrated in FIG. 3, the cylinder base includes a valve bore 56 including a valve seat 58. Fluid entering the advance port 50 will flow through a passage 54 into the valve bore 56, past the valve seat 58 and through a passage 60 to the advance end of the cylinder. Means are also provided for permitting flow of fluid from the advance port 50 into the advance end of the cylinder 40 but selectively locking the fluid in the advance end of the cylinder. In the illustrated arrangement the means for selectively locking the fluid in the advance end of the cylinder 40 includes a ball valve 62 housed in the valve bore 56 for movement toward and away from a position wherein the ball 62 engages the valve seat 58. The locking means also includes a compression spring 66 housed in the valve bore 56 and engaging the ball 62 to bias the ball into engagement with the valve seat 58. An opposite end of the compression spring is supported by a plug 68 fixed in place in the end of the bore 56.

In operation of the valve assembly, when the air or fluid pressure in the passage 54 is greater than the air pressure in the advance side of the cylinder 40, the pressure in the passage 54 may force the ball 62 away from the valve seat 58 against the force of the spring 66 to permit fluid flow into the advance end of the cylinder 40. If, on the other hand, the fluid pressure in the advance end of the cylinder 40 is greater than that in the advance port 50, the ball 62 will be forced against the valve seat 58 by the fluid pressure in the advance end of the cylinder and by the pressure of the spring 66 on the ball.

This construction provides a positive means for locking the piston 30 in position despite any sudden loss of fluid pressure in the supply line 46. One of the principal features of the invention is that in the event of a loss of fluid pressure in the supply line 46, there is no significant loss of fluid pressure in the advance end of the cylinder 40 and the locking force of the cylinder assembly 28 on the clamp arm 18 remains sufficiently high that the workpiece 12 is firmly held in position. For example, if there is air pressure in the advance end of the cylinder 40 applying a clamping force on the clamp member 18, in the event of a rupture of the air line 46 connected to the cylinder or some other failure causing an immediate loss of air pressure in the air pressure source, the air pressure in the fluid cylinder 40 will be locked in the cylinder and the clamping force on the workpiece 12 will be maintained.

Means are also provided for selectively forcing the ball 62 away from the valve seat 58 to permit discharge of air from the advance side of the cylinder 40 and movement of the piston the return position. In the arrangement shown in FIGS. 2–4, a plunger 70 is housed in an end portion 72 of the valve bore 56 in the cylinder base 42 and includes an end engageable with the ball 62 to force the ball away from the valve seat 58 against the force of the compression spring 66. A portion 74 of the valve bore 56 defines a cylinder, and the plunger includes an end portion 76 defining a piston. A fluid pressure port 78 and an air line 80 provide fluid communication between the return side of the cylinder 42 and the cylinder 74. In operation of the clamp 10, when the valve 48 is actuated to cause the advance side of the cylinder 40 to be exhausted, air pressure is supplied to the return side of the cylinder. This air pressure is also supplied by air line 80 to the port 78. The plunger 70 is then forced against the ball 62 to force the ball away from the valve seat 58 and to permit air to be vented from the advance side of the cylinder past the valve seat 58 through passage 54 and valve 48 to atmosphere.

In the illustrated arrangement means are also provided for permitting manual movement of the ball 62 away from the valve seat 58 and release the fluid pressure from the advance side of the cylinder. In the illustrated construction this means includes a manually operable release pin or second plunger 82 housed in the plunger cylinder 74 and including an end engageable with the piston head 76 of the plunger 70. The opposite end of the manually moveable pin 82 comprises a piston head 84 sealing the end of the cylinder 74, and a plug 86 is fixed in the end of the cylinder 74 to restrain the piston 84 against movement out of the cylinder 74. The piston 84 is located adjacent the periphery of the cylinder base 42 and an operator can insert a tool through a central aperture 85 in the plug 86 to apply pressure on the manually moveable pin 82 to thereby force the plunger 70 against the ball 62 and move the ball away from the valve seat 58 to thereby release the fluid pressure from the advance side of the cylinder and permit release of the clamp member 18.

In a preferred form of the invention illustrated in FIGS. 1–4, the valve bore 56 and the bore 72 and 74 housing the plunger 70 and the manually moveable pin 82, respectively, have a common longitudinal axis defining a chord extending through the cylinder base 42. This arrangement provides a construction which is conveniently machined and facilitates assembly of the various valve components.

In operation of the clamp arrangement, in the event of an air line failure, the locking valve assembly will lock air in the advance end of the pneumatic cylinder 40 and maintain the clamp member 18 in a clamped position. In the event of such a failure, it is often desirable to provide for release of the workpiece to permit removal of the workpiece and thereby facilitate commencement of a new machining operation once the air line is repaired. The construction of the locking valve assembly as illustrated in FIGS. 1–4 facilitates inclusion of the manually operable release plunger 82, and the provision of the manually operable plunger 82, in turn, permits convenient release of the clamp 18 and removal of the workpiece 12.

Figure 6:
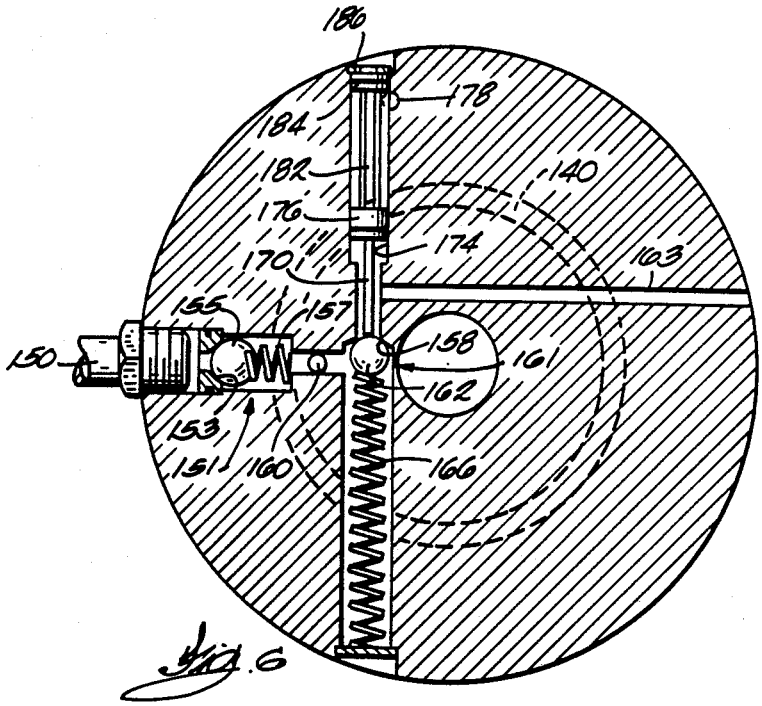
FIG. 6 is a view similar to FIG. 3 and showing an alternative embodiment of the invention.

Illustrated in FIG. 6 is an alternative embodiment of the apparatus described above in connection with FIGS. 2–4. In the illustration shown in FIG. 6, the advance port 150 includes a check valve 151 comprised of a valve seat 153, a ball 155 engageable with the valve seat 153 and a compression spring 157 positioned so as to bias the ball 155 toward the valve seat 153. The advance port 150 is connected by a passage 160 to the advance side of the cylinder 140. Exhaust of fluid from the advance side of the cylinder 140 is through a second check valve 161 and an exhaust passage 163. The second check valve includes a valve seat 158, a ball 162 engageable with the valve seat 158 and a compression spring 166 biasing the ball 162 into engagement with the valve seat 158.

Means are also provided for selectively opening the exhaust valve 161 when fluid pressure is supplied to the return side of the cylinder 40. This means for opening the valve is similar in structure and operation to the structure described above in connection FIGS. 2–4. A plunger 170 is housed in a bore 172 and is engageable with the ball 162. Fluid pressure from the return side of cylinder 140 is supplied through a port 178 to a cylinder 174 housing a piston end 176 of the plunger 170. Means are also provided for permitting an operator to cause manual movement of the plunger. This means includes a pin 182 having an end 184 accessible through a central opening in a plug 186. The pin 182 also includes an opposite end engageable with the piston end 176 of the plunger 170 such the pin 182 can be used to force the plunger 170 into engagement with the ball 162.

Figure 7:
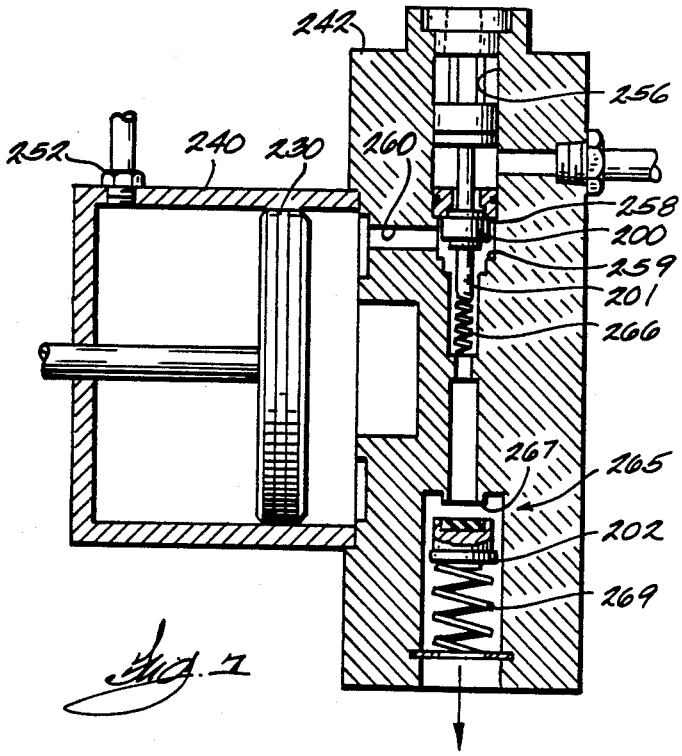
FIG. 7 is a view similar to FIG. 2 and showing another alternative embodiment of the invention in cross section.

Illustrated in FIG. 7 is another alternative embodiment of the invention and wherein a shuttle valve 200 and poppet valve 202 are employed to control the supply of air under pressure to the clamp cylinder 240 and to lock the air pressure in the advance side of the clamp cylinder 240 in the event of a failure of the air pressure source supplying air to the air cylinder. In the contruction shown in FIG. 7, the cylinder base 242 includes a valve bore 256 having one end connected to an air supply line 246. A second passage 260 provides fluid flow between the valve bore and the advance side of the pneumatic cylinder 240. The valve bore 256 includes a valve seat 258 between the air supply line 246 and the second passage 260, and the shuttle valve 200 is selectively engageable with the valve seat 258 to control air flow past the valve seat. A compression spring 266 housed in the valve bore 256 engages a pin 202 of the shuttle 200 to resiliently bias the shuttle 200 against the valve seat. The valve bore 256 also includes a second valve seat 259 in spaced relation to the first valve seat 258 and engaged by the shuttle 200 when the spring 266 is compressed. The valve bore 256 also includes a pressure relief valve assembly 265 comprised of a third valve seat 267 in the valve bore 256 and the poppet valve 202 selectively engageable with the third valve seat 269. A compression spring 269 selectively biases the poppet valve 202 into engagement with the third valve seat 267. In the illustrated arrangement, the compression spring 266 is substantially smaller than the compression spring 269 such that a smaller axial force on the shuttle 200 is required to effect movement of the shuttle 200 than is required on the relief poppet 202 to cause movement of the relief poppet 202 to an open position.

In operation of the apparatus illustrated in FIG. 7, when air pressure is supplied to the advance port 50, the shuttle 200 will move against the force of the spring 266 to an open position and the shuttle will engage the valve seat 259. Air pressure will be supplied to the advance side of the cylinder 240. In one common application, the air pressure supplied to the advance side of the cylinder will be 80 psi. When the air pressure to the advance port is interrupted and air pressure is supplied to the return port 252 of the cylinder, the compression spring 266 will move the shuttle 200 into engagement with the valve seat 258. Air in the advance side of the cylinder 240 can then force the poppet 202 away from the valve seat 267 and to thereby provide for exhaust of air from the advance side of the cylinder to the atmosphere and permit retraction of the piston 230.

In the event air pressure is being supplied to the advance side of the cylinder 240 and there is a sudden failure of the air pressure source, the spring 266 will force the shuttle 200 against the valve seat 258 to preclude exhaust of air through air line 246 and poppet 202 will be forced into engagement with the valve seat by the compression spring 269. A portion of the air in the advance side of the cylinder may be exhausted through the poppet if the air pressure on the poppet 202 exceeds the force of the compression spring 269 on the poppet but the poppet will lock the remaining air in the advance side of the cylinder. In one form of the invention, the compression spring 202 will apply sufficient force on the poppet 202 to maintain a 40 psi pressure in the advance side of the cylinder.

In other embodiments of the invention valve assemblies of the type described above can be operably connected to both ends of a pneumatic cylinder so as to lock the piston in any selected position and against movement in either direction.

Various features of the invention are set forth in the following claims.

We claim:

1. An apparatus for clampingly engaging a workpiece to support the workpiece, the apparatus comprising:

a base, a workpiece engaging member supported by the base for shiftable movement between a workpiece engaging position and a workpiece release position, and means for causing selective movement of the workpiece engaging member between the workpiece engaging position and the workpiece release position, the means for causing selective movement including a pneumatic cylinder assembly including:

a cylinder having a cylinder base, and a piston housed in the cylinder and reciprocably moveable in the cylinder, the piston being connected to the workpiece engaging member such that movement of the piston in a first direction causes movement of the workpiece engaging member to the workpiece engaging position and movement of the piston in an opposite direction causes movement of the workpiece engaging member to a release position, means for supplying air pressure to the cylinder, the means for supplying air pressure being adapted to be connected to an air pressure source and including means for selectively locking air in the cylinder in the event the supply of air pressure to the cylinder is interrupted, the means for selectively locking air in the cylinder including a valve bore, a first portion of the valve bore being in communication with the source of air pressure, and a second portion of the valve bore communicating with one end of the cylinder whereby air can be supplied to the cylinder to cause movement of the piston in the first direction, a valve seat between the first portion of the valve bore and the second portion of the valve bore, a valve member selectively engageable with the valve seat, means for resiliently biasing the valve member against the valve seat to releasably prevent air flow from the air pressure source to the first end of the cylinder, and means for forcing the valve member away from the valve seat to thereby permit exhaust of air pressure from the one end of the cylinder in response to application of air pressure in an opposite end of the cylinder.

2. An apparatus as set forth in claim 1 wherein the valve bore is formed in the cylinder base.

3. An apparatus as set forth in claim 1 wherein said means for forcing the valve member away from the valve seat includes a valve cylinder and a plunger housed in the valve cylinder, the plunger including opposite ends, one end of the plunger being adapted to selectively engage the valve member to force the valve member away from the valve seat and an opposite end of the plunger comprising a plunger piston, and means for providing fluid communication between the opposite end of the clamp cylinder and the valve cylinder.

4. An apparatus as set forth in claim 3 wherein the valve cylinder comprises a portion of the valve bore.

5. An apparatus as set forth in claim 1 and further including means for manually forcing the valve member away from valve seat.

6. An apparatus as set forth in claim 4 wherein the means for manually forcing the valve member away from the valve seat includes a pin having opposite ends, one end of the pin being adapted to engage the plunger to force the plunger into engagement with the valve member to move the valve member away from the valve seat.

7. An apparatus as set forth in claim 6 wherein the pin includes an opposite end adjacent to the periphery of the cylinder base and adapted to be manually engaged whereby the pin can be forced against the plunger to cause the plunger to move the valve member away from the valve seat.

8. An apparatus for engaging an article to support the article in place, the apparatus comprising:

a base, an article engaging member supported by the base for shiftable movement between a article engaging position and an article release position, and means for causing selective movement of the article engaging member between the article engaging position and the article release position, the means for causing selective movement including a pneumatic cylinder assembly including:

a cylinder having a cylinder base, and a piston housed in the cylinder and reciprocably moveable in the cylinder, the piston being connected to the article engaging member such that movement of the piston in a first direction causes movement of the article engaging member to the article engaging position and movement of the piston in an opposite direction causes movement of the article engaging member to a release position, and means for supplying air pressure to the cylinder, the means for supplying air pressure being adapted to be connected to an air pressure source and including means for selectively locking air in the cylinder in the event the supply of air pressure to the cylinder is interrupted, the means for selectively locking air in the cylinder including a valve bore formed in the cylinder base, a first portion of the valve bore being in communication with the source of air pressure, and a second portion of the valve bore communication with one end of the cylinder whereby air can be supplied to the cylinder to cause movement of the piston in the first direction, valve seat between the first portion of the valve bore and the second portion of the valve bore, a valve member selectively engageable with the valve seat, means for resiliently biasing the valve member against the valve seat to releasably prevent air flow from the air pressure source to the first end of the cylinder, and means for forcing the valve member away from the valve seat in response to application of air pressure to an opposite end of the cylinder.

9. An apparatus as set forth in claim 8 wherein said means for forcing the valve member away from the valve seat includes a valve cylinder and a plunger housed in the valve cylinder, the plunger including opposite ends, one end of the plunger being adapted to selectively engage the valve member to force the valve member away from the valve seat and an opposite end of the plunger comprising a plunger piston, and means for providing fluid communication between the opposite end of the clamp cylinder and the valve cylinder.

10. An apparatus as set forth in claim 9 wherein the valve cylinder comprises a portion of the valve bore.

11. An apparatus as set forth in claim 8 and further including means for manually forcing the valve member away from valve seat.

12. An apparatus as set forth in claim 11 wherein the means for manually forcing the valve member away from the valve seat includes a pin having opposite ends, one end of the pin being adapted to engage the plunger to force the plunger into engagement with the valve member to move the valve member away from the valve seat.

13. An apparatus as set forth in claim 12 wherein the pin includes an opposite end adjacent to the periphery of the cylinder base and adapted to be manually engaged whereby the pin can be forced against the plunger to cause the plunger to move the valve member away from the valve seat.

14. An apparatus for engaging an article to support the article in place, the apparatus comprising:

a base, an article engaging member supported by the base for shiftable movement between a article engaging position and an article release position, and means for causing selective movement of the article engaging member between the article engaging position and the article release position, the means for causing selective movement including a pneumatic cylinder assembly including:

a cylinder having a cylinder base, and a piston housed in the cylinder and reciprocably moveable in the cylinder, the piston being connected to the article engaging member such that movement of the piston in a first direction causes movement of the article engaging member to the article engaging position and movement of the piston in an opposite direction causes movement of the article engaging member to a release position, and means for supplying air pressure to the cylinder, the means for supplying air pressure being adapted to be connected to an air pressure source and including means for selectively locking air in the cylinder in the event the supply of air pressure to the cylinder is interrupted, the means for selectively locking air in the cylinder including a valve bore formed in the cylinder base, a first portion of the valve bore being in communication with the source of air pressure, and a second portion of the valve bore communication with one end of the cylinder whereby air can be supplied to the cylinder to cause movement of the piston in the first direction, a valve seat between the first portion of the valve bore and the second portion of the valve bore, a valve member selectively engageable with the valve seat, means for resiliently biasing the valve member against the valve seat to releasably prevent air flow from the air pressure source to the first end of the cylinder, and means for forcing the valve member away from the valve seat in response to application of air pressure to an opposite end of the cylinder, and means for forcing the valve member away from the valve seat including a valve cylinder comprising a portion of the valve bore and a plunger housed in the valve cylinder, the plunger including opposite ends, one end of the plunger being adapted to selectively engage the valve member to force the valve member away from the valve seat and an opposite end of the plunger comprising a plunger piston, and means for providing fluid communication between the opposite end of the clamp cylinder and the valve cylinder, and means for selectively manually forcing the valve member away from the valve seat, the means for manually forcing the valve member away from the valve seat including a pin having opposite ends, one end of the pin being adapted to engage the plunger to force the plunger into engagement with the valve member to move the valve member away from the valve seat, and the pin including an opposite end adjacent to the periphery of the cylinder base and adapted to be manually engaged whereby the pin can be forced against the plunger to cause the plunger to move the valve member away from the valve seat.

* * * * *